US006314742B1

(12) United States Patent
Yoneda

(10) Patent No.: US 6,314,742 B1
(45) Date of Patent: Nov. 13, 2001

(54) DOUBLE-TUBE TYPE HEAT EXCHANGER AND REFRIGERATING MACHINE USING THE HEAT

(75) Inventor: Yuji Yoneda, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/529,788

(22) PCT Filed: Jul. 22, 1999

(86) PCT No.: PCT/JP99/03931

§ 371 Date: Apr. 20, 2000

§ 102(e) Date: Apr. 20, 2000

(87) PCT Pub. No.: WO00/11417

PCT Pub. Date: Mar. 2, 2000

(30) Foreign Application Priority Data

Aug. 21, 1998 (JP) ..... 10-235470

(51) Int. Cl.[7] ..... F25B 19/00
(52) U.S. Cl. ..... 62/51.1; 62/513
(58) Field of Search ..... 62/50.1, 50.2, 62/513, 51.1

(56) References Cited

U.S. PATENT DOCUMENTS 4,316,366 * 2/1982 Manning ..... 62/513
4,696,168 * 9/1987 Woods et al. ..... 62/513
4,715,187 * 12/1987 Stearns ..... 62/50.1
5,388,415 * 2/1995 Glinka et al. ..... 62/51.2
5,561,983 * 10/1996 Remes et al. ..... 62/50.2

FOREIGN PATENT DOCUMENTS 8233378 9/1996 (JP) .

* cited by examiner

*Primary Examiner*—Ronald Capossela
(74) *Attorney, Agent, or Firm*—Birch, Stewart, Kolasch & Birch, LLP

(57) ABSTRACT

A double-tube type heat exchanger has a restriction hole (6), formed on an inner tube (3), through which a refrigerant introduced into an outer tube (3) is introduced into the inner tube (3) while the refrigerant expands. Therefore, a part of the refrigerant introduced into the outer tube (3) can be introduced into the inner tube (2) from the restriction hole (6) while the refrigerant expands. That is, the restriction hole (6) formed on the inner tube (2) serves as an expansion mechanism of a bypass flow. Therefore, this double-tube type heat exchanger (1) allows an injection circuit or a super-cooling circuit to be compactly and inexpensively constructed.

11 Claims, 6 Drawing Sheets

DOUBLE-TUBE TYPE HEAT EXCHANGER AND REFRIGERATING MACHINE USING THE HEAT

This application is the national phase under 35 U.S.C. §371 of PCT International Application No. PCT/JP99/03931 which has an International filing date of Jul. 22, 1999, which designated the United States of America.

TECHNICAL FIELD

The present invention relates to a double-tube type heat exchanger to be used for a super-cooling circuit of a refrigerator and a gas injection circuit thereof to perform heat-exchange between a main flow of a refrigerant and a bypass flow thereof and a refrigerator using it.

BACKGROUND ART

As shown in FIG. 2, a double-tube type heat exchanger having a cylindrical inner tube 101 and an outer tube 102 so surrounding the peripheral surface of the inner tube 101 as to enclose it is known. A port 105 at one end of the outer tube 102 of a double-tube type heat exchanger 103 is connected to an outflow end 107A of a rectification circuit 107, while a port 106 at the other end of the outer tube 102 is connected to an inflow end 107B of the rectification circuit 107 via a main electromotive-expansion valve 108. The outflow end 107A is connected to an hole 111 of the inner tube 101 on the upstream side thereof via a bypass electromotive-expansion valve 112. An hole 113 of the inner tube 101 on the downstream side thereof is connected to a bypass pipe 115.

The rectification circuit 107 has four check valves 121, 122, 123, and 124 connected in a forward direction from the inflow end 107B to the outflow end 107A. A connection pipe 107C connecting the check valves 121 and 123 to each other and a connection pipe 107D connecting the check valves 122 and 124 to each other serve as the connection pipes connected to a main-flow circuit. A thermostat 119 installed on a bypass pipe 114 detects the temperature of a bypass-flow refrigerant. Temperature information detected by the thermostat 119 is used to control an open degree of the bypass electromotive-expansion valve 112.

As shown in FIG. 3, a gas injection circuit can be constructed by connecting the bypass pipe 115 to an intermediate-pressure position of a compressor 116 and by connecting connection pipes 107C and 107D to an outdoor heat exchanger 201 and an indoor heat exchanger 202, respectively. According to the gas injection circuit, in a cooling time, a refrigerant discharged from the outdoor heat exchanger 201 serving as a condenser is expanded by the bypass electromotive-expansion valve 112 and introduced into the inner tube 101. After the refrigerant is heated by a main-flow refrigerant inside the outer tube 102, it can be injected to the intermediate-pressure position of the compressor 116 via the bypass pipe 115. In a heating time, a refrigerant discharged from the indoor heat exchanger 202 serving as a condenser is heated by a refrigerant inside the outer tube 102 after the refrigerant passes through the bypass electromotive-expansion valve 112 and the inner tube 101. Then, the refrigerant can be injected to the intermediate-pressure position of the compressor 116 via the bypass pipe 115.

As shown in FIG. 4, by connecting the bypass pipe 115 to an intake side of the compressor 116 and connecting the connection pipes 107C and 107D to the outdoor heat exchanger 201 and the indoor heat exchanger 202, respectively, a super-cooling circuit can be constructed. According to the super-cooling circuit, in a cooling time, a refrigerant discharged from the outdoor heat exchanger 201 is expanded by the bypass expansion valve 112 and introduced into the inner tube 101. After a main-flow refrigerant inside the outer tube 102 is super-cooled, the refrigerant can be returned to the intake side of the compressor 116 via the bypass pipe 115. In a heating time, a refrigerant discharged from the indoor heat exchanger 202 is expanded by the bypass electromotive-expansion valve 112 and introduced into the inner tube 101. After the main-flow refrigerant inside the outer tube 102 is super-cooled, the refrigerant can be returned to the intake side of the compressor 116 via the bypass pipe 115.

However, according to the conventional double-tube type heat exchanger 103, in order to construct the gas injection circuit or the super-cooling circuit, a pressure-reducing mechanism, namely, the bypass electromotive-expansion valve 112 is required as described above. The bypass electromotive-expansion valve 112 causes the construction of the conventional double-tube type heat exchanger 103 to be complicated and its cost to increase.

SUMMARY OF THE INVENTION

It is therefore an object of the present invention to provide a double-tube type heat exchanger allowing a gas injection circuit or a super-cooling circuit to be compact and inexpensive and provide a refrigerator using the above double-tube type heat exchanger.

To achieve the object, the present invention provides a double-tube type heat exchanger for heat-exchanging between a refrigerant flowing through an outer passage and a refrigerant flowing through an inner passage, comprising a restriction passage, communicating between the inner passage and the outer passage, through which a refrigerant introduced into the outer passage is introduced into the inner passage while the refrigerant of the outer passage expands.

In the double-tube type heat exchanger of the present invention, a part of the refrigerant introduced into the outer passage is introduced into the inner passage through the restriction passage while the refrigerant of the outer passage expands. Heat exchange is made between the expanded bypass refrigerant introduced into the inner passage and the main-flow refrigerant flowing in the outer passage. Accordingly, in the case where a gas injection circuit is constructed from the double-tube type heat exchanger of the present invention, the bypass refrigerant can be gasified with the main-flow refrigerant. In the case where a super-cooling circuit is constructed from the double-tube type heat exchanger of the present invention, the main-flow refrigerant can be super-cooled with the bypass refrigerant.

According to the double-tube type heat exchanger of the present invention, the restriction passage allowing communication between the inner passage and the outer passage with each other serves as an expansion mechanism for a bypass flow. Therefore, it is possible to construct the injection circuit and the super-cooling circuit which are compact and inexpensive.

In one embodiment of the present invention, there is provided a refrigerator comprising a gas injection circuit having the double-tube type heat exchanger wherein an inflow port of an outer passage of the double-tube type heat exchanger is connected to a condenser, an outflow port of the outer passage is connected to an evaporator via an expansion mechanism, and an outflow port of the inner passage is connected to an intermediate-pressure position of a compressor with a bypass pipe.

According to the refrigerator of this embodiment, the restriction passage of the double-tube type heat exchanger serves as an expansion mechanism for the gas injection circuit. Therefore, it is possible to construct the refrigerator having the compact and inexpensive gas injection circuit without adding a pressure-reducing mechanism thereto.

BRIEF DESCRIPTION OF THE PREFERRED EMBODIMENT

Figure 1:
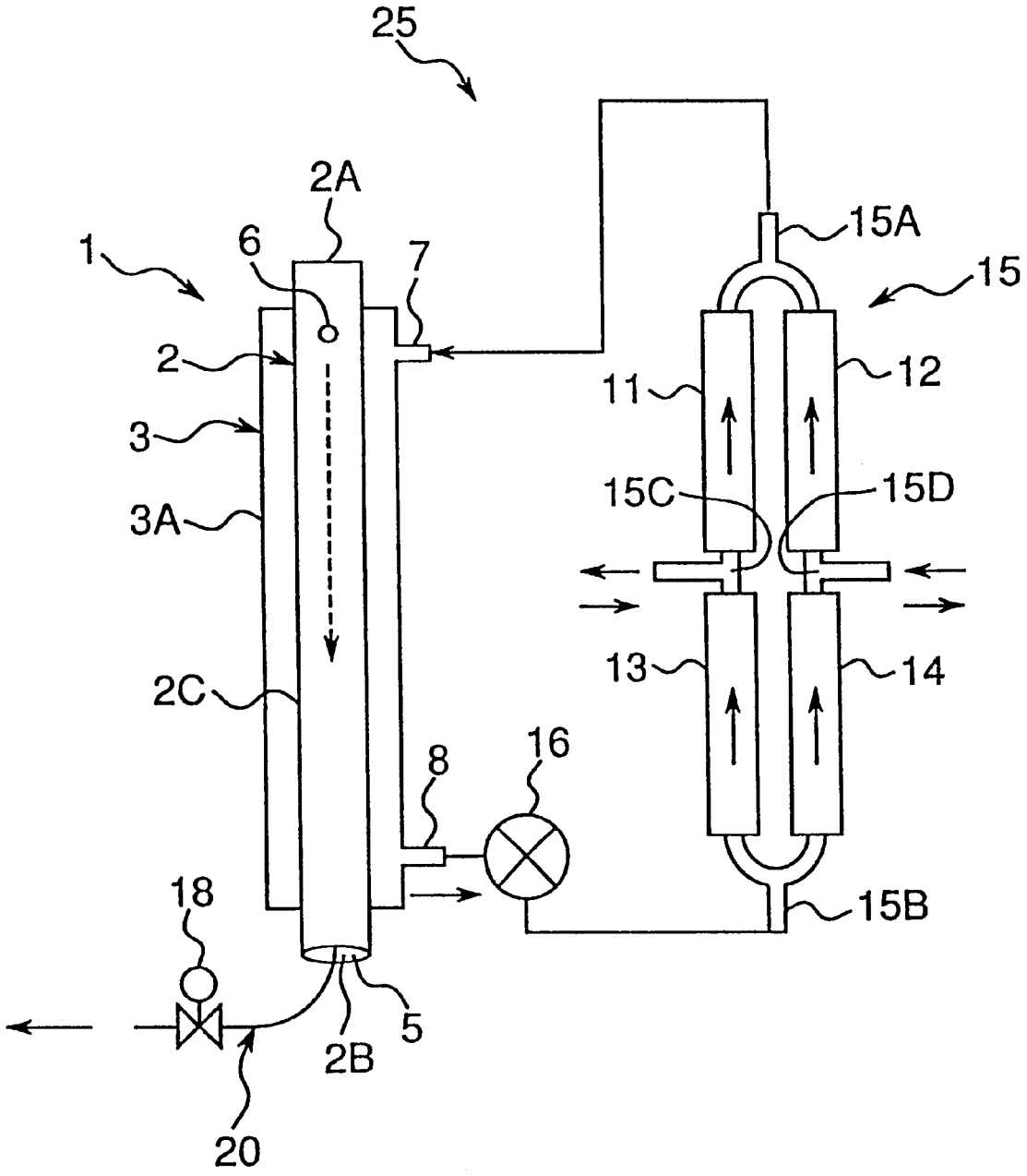
FIG. 1 is a diagram of a circuit including a double-tube type heat exchanger of an embodiment of the present invention and a rectification circuit.
Figure 2:
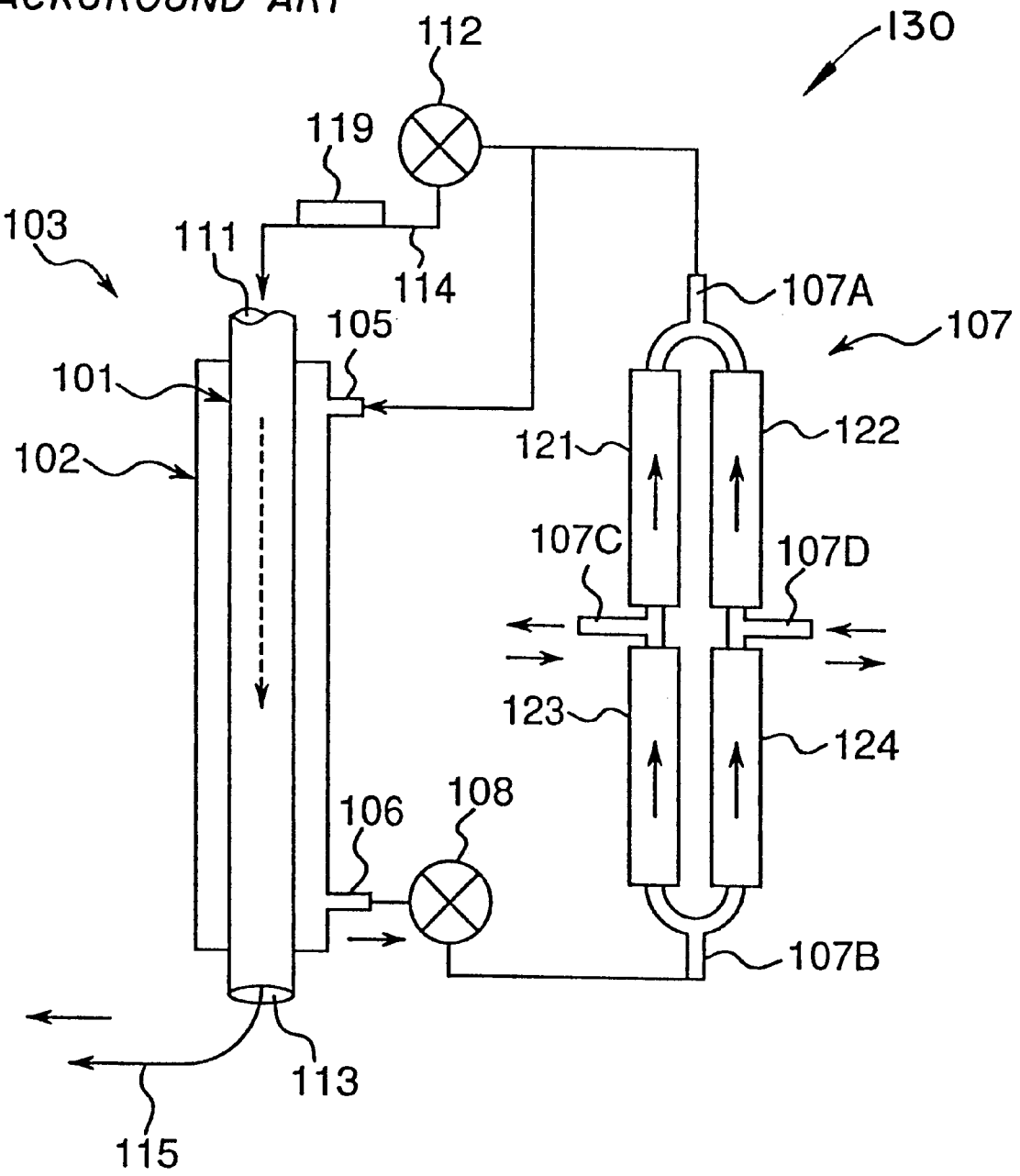
Fig.2 BACKGROUND ART
FIG. 2 is a diagram of a circuit having a conventional double-tube type heat exchanger.

The present invention will be described in detail below with reference to embodiments shown in the drawings.

FIG. 1 shows an embodiment of a double-tube type heat exchanger of the present invention. The double-tube type heat exchanger 1 has an inner tube 2 and an outer tube 3. The inner tube 2 is approximately cylindrical. One end 2A of the inner tube 2 is closed, whereas the other end 2B thereof is open to form a port 5. A small-diameter restriction hole 6 serving as a restriction passage is formed on a peripheral surface of the inner tube 2 such that the restriction hole 6 is located in the vicinity of the one end 2A of the inner tube 2. The outer tube 3 is so fixed to the peripheral surface of the inner tube 2 as to enclose a part 2C of the inner tube 2 between both the ends 2A and 2B thereof. The outer tube 3 has an inlet 7 and an outlet 8 in the neighborhood of one and other ends of a peripheral surface 3A thereof, respectively.

The inlet 7 of the outer tube 3 of the double-tube type heat exchanger 1 is connected to an outflow end 15A of a rectification circuit 15 constructed of four check values 11, 12, 13, and 14. The outlet 8 of the outer tube 3 is connected to an inflow end 15B of the rectification circuit 15 via a main electromotive-expansion valve 16. The port 5 of the inner tube 2 of the double-tube type heat exchanger 1 is connected to a bypass pipe 20 having an electromagnetic valve 18 installed thereon.

The check valves 11, 12, 13, and 14 constituting the rectification circuit 15 are connected in a forward direction from the inflow end 15B to the outflow end 15A such that the check valves 11 and 13 are connected in series with each other and the check valves 12 and 14 are connected in series with each other. A connection point 15C of the check valves 11 and 13 and a connection point 15D of the check valves 12 and 14 are connected to a main-flow refrigerant circuit. That is, a circuit 25 constructed of the double-tube type heat exchanger 1 and the rectification circuit 15 shown in FIG. 1 constitutes a gas injection circuit or a super-cooling circuit by replacing, with the circuit 25, the circuit 130 which includes the conventional double-tube type heat exchanger 103 and is surrounded with a broken line as shown in FIGS. 3 and 4.

Description on an operation of a refrigerator is made below in the case where the gas injection circuit is formed by replacing the conventional circuit 130 shown in FIG. 3 with the circuit 25 having the above-stated double-tube type heat exchanger 1. In this case, in a cooling time when a four-way selector valve 203 is switched to select paths shown with solid lines, a refrigerant discharged from the outdoor heat exchange 201 serving as a condenser is introduced into the inlet 7 of the outer tube 3 of the double-tube type heat exchanger 1 through the check valve 11 of the rectification circuit 15. A refrigerant serving as a main flow of the refrigerant introduced into the inlet 7 of the outer tube 3 is discharged from the outlet 8 through the outer tube 3, is expanded by the main electromotive-expansion valve 16, passes through the check valve 14 of the rectification circuit 15, and is introduced into the indoor heat exchanger 202 operating as an evaporator. On the other hand, of the refrigerant introduced into the inlet 7 of the outer tube 3, a refrigerant which has entered the inner tube 2 from the small-diameter restriction hole 6 while the refrigerant expands is heat-exchanged with the main-flow refrigerant, is gasified, is discharged from the port 5 of the other end 2B, passes through the electromagnetic valve 18 of the bypass pipe 20, and is injected to the intermediate-pressure position of the compressor 116. In a heating time when the four-way selector valve 203 is switched to select paths shown with broken lines, a refrigerant discharged from the indoor heat exchange 202 serving as a condenser is introduced into the inlet 7 of the outer tube 3 of the double-tube type heat exchanger 1 through the check valve 12 of the rectification circuit 15. A refrigerant serving as a main flow of the refrigerant introduced into the inlet 7 of the outer tube 3 is discharged from the outlet 8 through the outer tube 3, is expanded by the main electromotive-expansion valve 16, passes through the check valve 13 of the rectification circuit 15, and is introduced into the outdoor heat exchanger 201 operating as an evaporator. On the other hand, of the refrigerant introduced into the inlet 7 of the outer tube 3, a refrigerant which has entered the inner tube 2 from the small-diameter restriction hole 6 while the refrigerant expands is heat-exchanged with the main-flow refrigerant, is gasified, is discharged from the port 5 of the other end 2B, passes through the electromagnetic valve 18 of the bypass pipe 20, and is injected to the intermediate-pressure position of the compressor 116. By hole and closing the electromagnetic valve 18, gas injection can be turned on and off.

Figure 3:
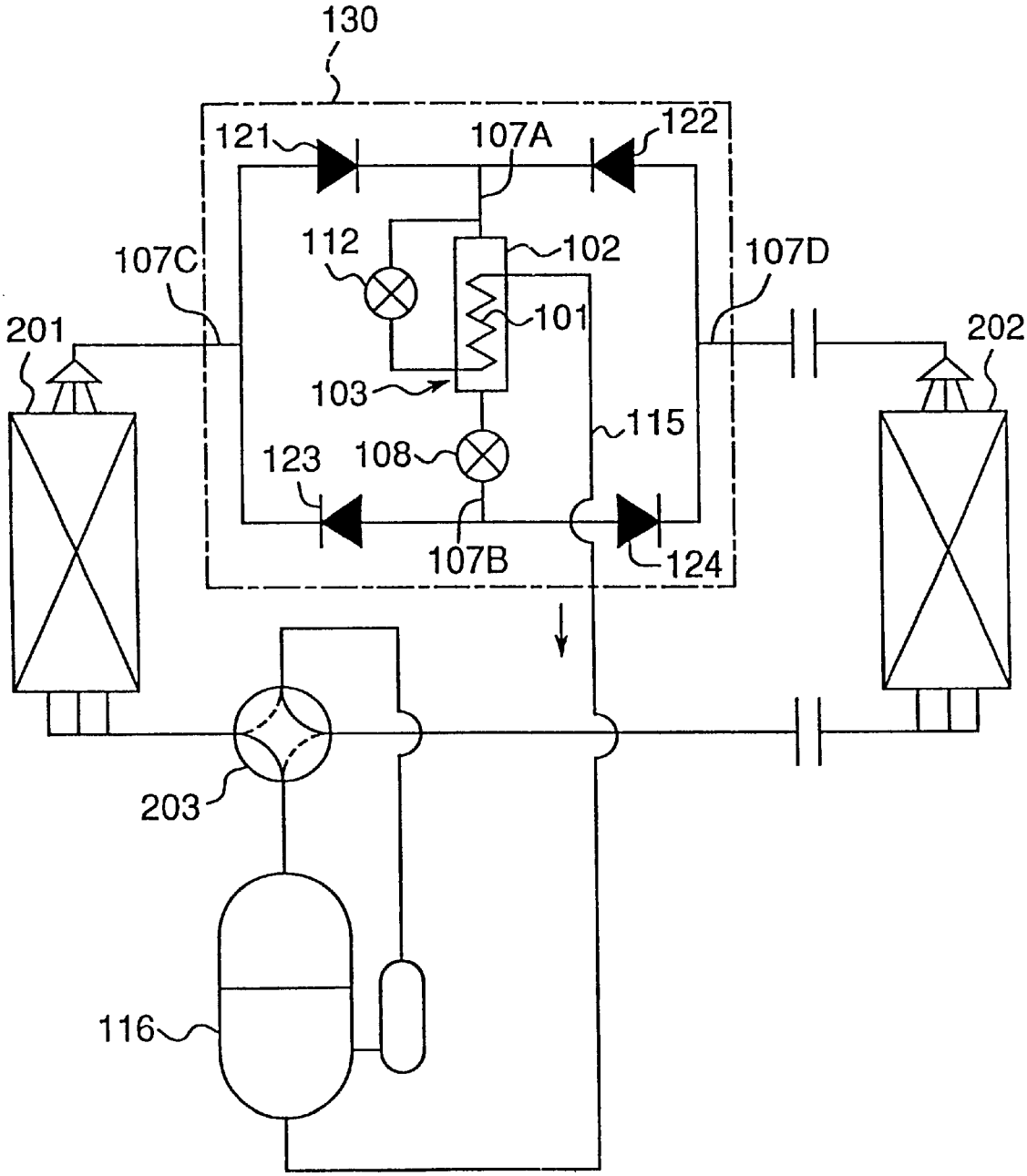
Fig.3 BACKGROUND ART
FIG. 3 is a circuit diagram of a refrigerator including a gas injection circuit having the conventional double-tube type heat exchanger.
Figure 4:
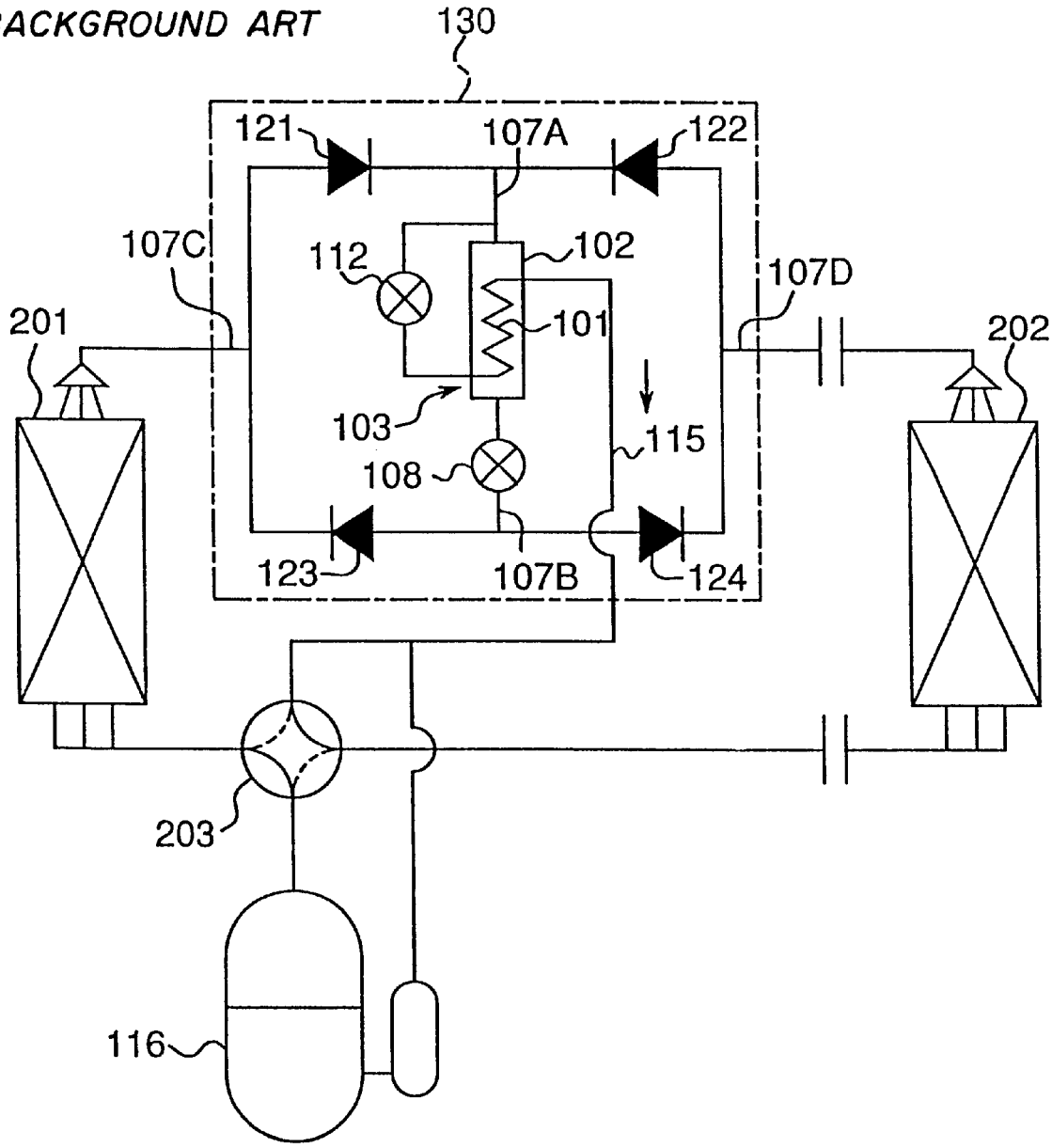
Fig.4 BACKGROUND ART
FIG. 4 is a circuit diagram of a refrigerator including a super-cooling circuit having the conventional double-tube type heat exchanger.
Figure 5:
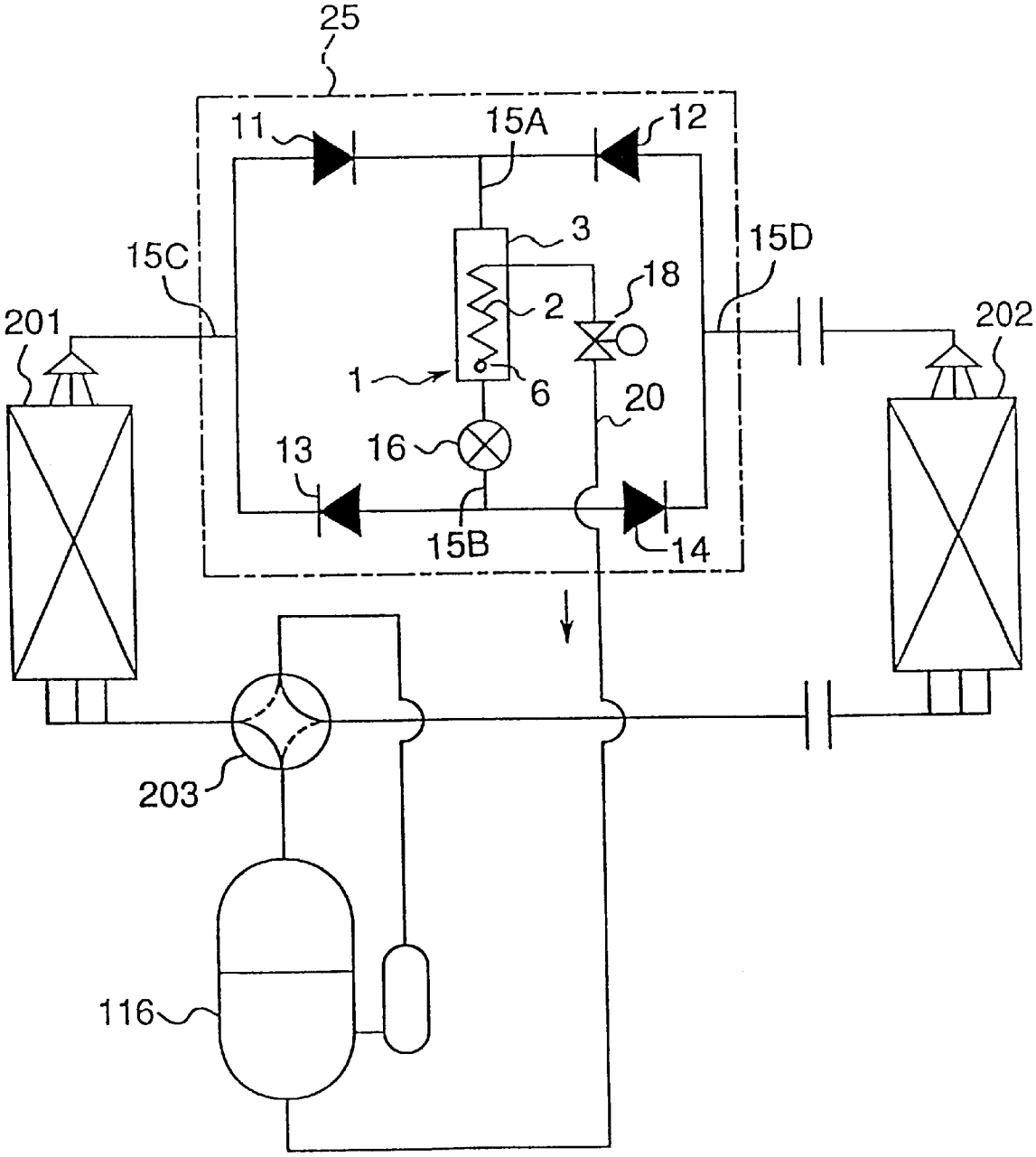
FIG. 5 is a circuit diagram of a refrigerator including a gas injection circuit having the double-tube type heat exchanger of the present invention.
Figure 6:
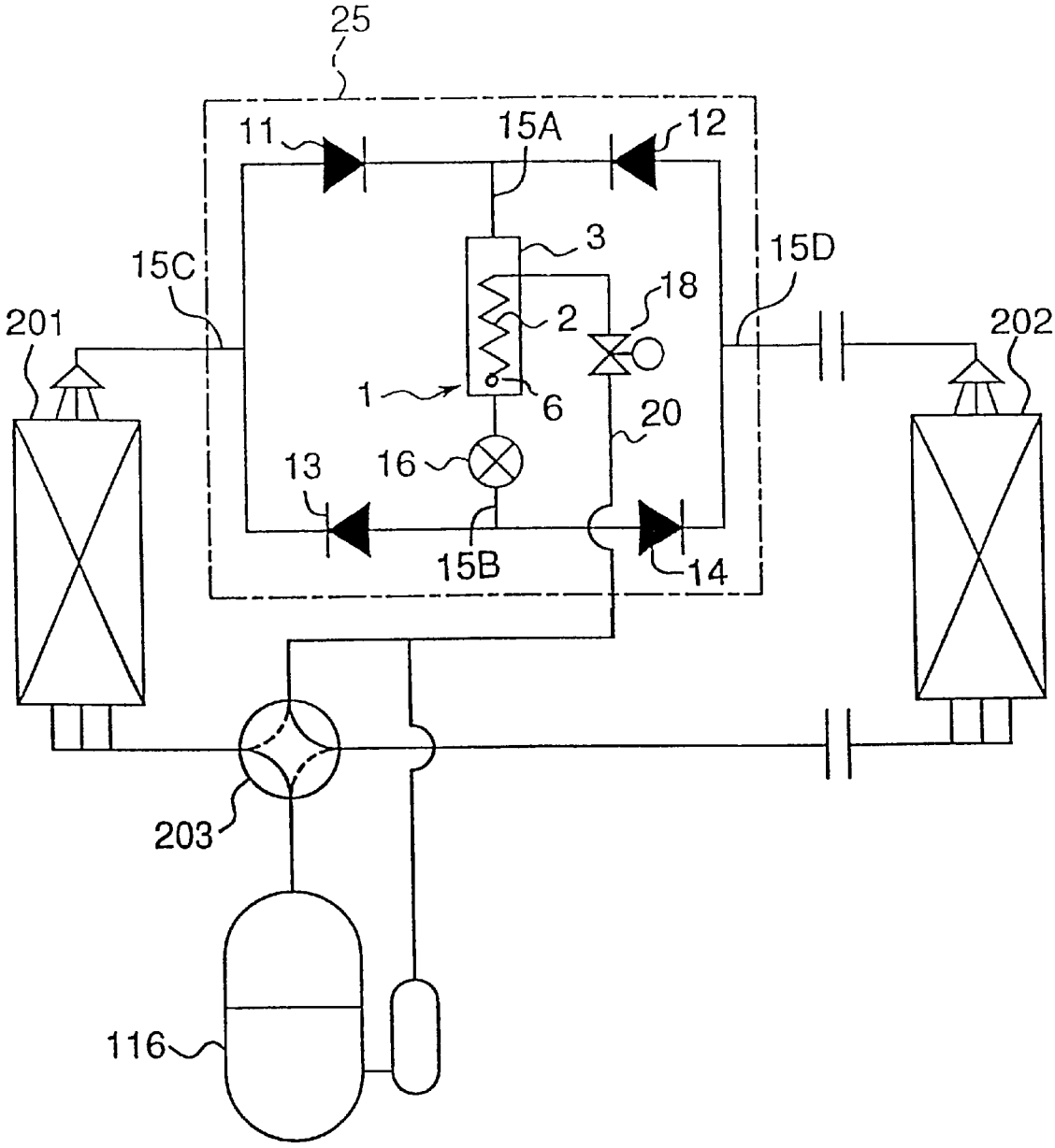
FIG. 6 is a circuit diagram of a refrigerator including a super-cooled circuit having the double-tube type heat exchanger of the present invention.

As described above, according to the double-tube type heat exchanger 1 of the embodiment, the small-diameter restriction hole 6 formed on the peripheral surface of the inner tube 2 serves as the bypass electromotive-expansion valve 112 shown in FIGS. 3 and 4. Therefore, the double-tube type heat exchanger 1 allows a gas injection circuit to be constructed without adding a pressure-reducing mechanism thereto. Thus, it is possible to prevent the gas injection circuit from being complicated and its cost from being increased and allow it to be compact and inexpensive.

The circuit 25 shown in FIG. 1 can be used to construct a super-cooling circuit by replacing the conventional circuit 130 shown in FIG. 4 with the circuit 25. In this case, as in the case of the above-described gas injection circuit, the small-diameter restriction hole. 6 formed on the inner tube 2 of the double-tube type heat exchanger 1 serves as an expansion mechanism for a bypass flow. Therefore, it is possible to construct the super-cooling circuit without adding an expansion mechanism thereto. Therefore, it is possible to construct the compact and inexpensive super-cooling circuit.

In the above embodiment, the small-diameter restriction hole 6 formed on the inner tube 2 serves as the restriction passage. However, a small-diameter restriction tube connecting between the peripheral surface 3A in the vicinity of the inlet 7 of the outer tube 3 and the end 2A of the inner tube 2 may be used as the restriction passage. By the restriction tube, the refrigerant introduced into the outer tube 3 is introduced into the inner tube 2 while the refrigerant expands. In the description of the embodiment, the circuit 25 is constructed by combining the double-tube type heat exchanger 1 and the rectification circuit 15 with each other to use it for cooling and heating purpose. When a refrigerator to which the double-tube type heat exchanger 1 is applied is used for only cooling purpose, the rectification circuit 15 may be omitted.

Industrial Applicability

The present invention is applicable to a double-tube type heat exchanger and a refrigerator using it and useful for constructing a compact and inexpensive gas injection circuit and super-cooling circuit.

What is claimed is:

1. A double-tube type heat exchanger for the heat exchanging a refrigerant, comprising:

an inner tube having a closed end and an open end;

an outer tube having an inlet and an outlet, the outer tube surrounding the inner tube; and a restriction passage formed on a peripheral surface of the inner tube and communicating between the inner tube and the outer tube, wherein the refrigerant introduced into the outer tube is introduced into the inner tube while the refrigerant of the outer tube expands.

2. The heat exchanger according to claim 1, wherein the restriction passage is located near the closed end of the inner tube.

3. The heat exchanger according to claim 1, wherein the open end of the inner tube further comprises a port, the port connected to a bypass pipe.

4. The heat exchanger according to claim 3, wherein the bypass pipe further comprises an electromagnetic valve.

5. The heat exchanger according to claim 1, wherein the inlet of the outer tube is connected to an outflow end of a rectification circuit.

6. The heat exchanger according to claim 5, wherein the outlet of the outer tube is connected to an inflow end of the rectification circuit.

7. The heat exchanger according to claim 6, wherein the inflow end of the rectification circuit further comprises a main electromotive expansion valve.

8. The heat exchanger according to claim 5, wherein the rectification circuit is constructed of four check valves.

9. The heat exchanger according to claim 1, wherein the inlet of the outer tube is near the closed end of the inner tube and the outlet of the outer tube is near the open end of the inner tube.

10. A gas injection circuit having a double-tube type heat exchanger for heat exchanging a refrigerant including an inner tube having a closed end and an open end, an outer tube having an inlet and an outlet, and a restriction passage communicating between the inner tube and the outer tube, the gas injection circuit comprising:

a condenser connected to the inlet of the outer tube;

an evaporator connected to the outlet of the outer tube, wherein an expansion mechanism is provided between the evaporator and the outlet of the outer tube; and an outflow port in the inner tube connected to an intermediate-pressure position of a compressor with a bypass pipe.

11. A super cooling circuit having a double-tube type heat exchanger for heat exchanging a refrigerant including an inner tube having a closed end and an open end, an outer tube having an inlet and an outlet, and a restriction passage communicating between the inner tube and the outer tube, the gas injection circuit comprising:

a condenser connected to the inlet of the outer tube;

an evaporator connected to the outlet of the outer tube, wherein an expansion mechanism is provided between the evaporator and the outlet of the outer tube; and an outflow port in the inner tube connected to an intermediate-pressure position of a compressor with a bypass pipe.

* * * * *